US009353581B2

(12) United States Patent
Megens et al.

(10) Patent No.: US 9,353,581 B2
(45) Date of Patent: May 31, 2016

(54) PLUNGER-TYPE WIRE RISER TENSIONER

(75) Inventors: Peter Megens, Eindhoven (NL); Peter Claessens, Eindhoven (NL); Bilal Said, Ann Arbor, MI (US); Nico Renders, Eindhoven (NL)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 14/391,446

(22) PCT Filed: Apr. 12, 2012

(86) PCT No.: PCT/US2012/033317

§ 371 (c)(1),
(2), (4) Date: Mar. 16, 2015

(87) PCT Pub. No.: WO2013/154566

PCT Pub. Date: Oct. 17, 2013

(65) Prior Publication Data

US 2015/0184470 A1 Jul. 2, 2015

(51) Int. Cl.

| | |
|---|---|
| ***E21B 19/00*** | (2006.01) |
| ***E21B 17/01*** | (2006.01) |
| ***F15B 1/08*** | (2006.01) |
| ***F15B 15/14*** | (2006.01) |

(52) U.S. Cl.

CPC ..... *E21B 19/006* (2013.01); *E21B 17/01* (2013.01); *F15B 1/08* (2013.01); *F15B 15/14* (2013.01); *F15B 2201/205* (2013.01); *F15B 2201/305* (2013.01); *Y10T 29/49249* (2015.01)

(58) Field of Classification Search

CPC .. E21B 17/01; E21B 19/006; F15B 2201/205
USPC ..... 166/345, 350, 355, 358, 367
See application file for complete search history.

(56) References Cited

U.S. PATENT DOCUMENTS

| | | | | |
|---|---|---|---|---|
| 1,594,531 | A | 8/1926 | Kucera | |
| 3,669,151 | A * | 6/1972 | Fleming | F15B 1/027 137/116.5 |
| 4,367,981 | A * | 1/1983 | Shapiro | E21B 7/128 166/355 |
| 4,487,150 | A | 12/1984 | Shanks et al. | |
| 4,615,542 | A * | 10/1986 | Ideno | E21B 17/01 166/352 |
| 4,781,061 | A * | 11/1988 | Baumgartl | F15B 1/08 73/149 |
| 4,799,827 | A * | 1/1989 | Jaqua | E21B 19/006 166/350 |
| 5,069,488 | A * | 12/1991 | Freyer | E21B 19/006 166/355 |
| 5,252,004 | A | 10/1993 | Butler et al. | |

(Continued)

FOREIGN PATENT DOCUMENTS

FR 2 044 794 A1 2/1971

OTHER PUBLICATIONS

International Search Report for corresponding International Patent Application No. PCT/US2012/033317 mailed Dec. 12, 2012.

*Primary Examiner* — James G Sayre
(74) *Attorney, Agent, or Firm* — Merchant & Gould P.C.

(57) ABSTRACT

Certain types of riser tensioner arrangements include a high-pressure accumulator; a pusher-type hydraulic cylinder; a first flow path coupling the high-pressure accumulator with a first volume of the cylinder to enable a first high-pressure fluid to flow therebetween; and a second flow path coupling the high-pressure accumulator with a second volume of the cylinder to enable a second high-pressure fluid to flow therebetween. The piston includes a seat and a hollow extension that defines part of the second volume of the cylinder.

18 Claims, 4 Drawing Sheets

(56) References Cited

U.S. PATENT DOCUMENTS

| | | | | |
|---|---|---|---|---|
| 5,542,453 | A | 8/1996 | Gabas | |
| 5,613,418 | A | 3/1997 | Guido | |
| 5,624,105 | A * | 4/1997 | Runkel | B60G 11/30 138/31 |
| 7,008,340 | B2 * | 3/2006 | Williams | E21B 19/006 166/355 |
| 7,329,070 | B1 | 2/2008 | Trent et al. | |
| 8,875,794 | B2 * | 11/2014 | Carlsen | E21B 19/006 166/345 |
| 2004/0108117 | A1 * | 6/2004 | Williams | E21B 19/09 166/355 |
| 2014/0034329 | A1 * | 2/2014 | Skinnes | E21B 19/09 166/355 |

* cited by examiner

PLUNGER-TYPE WIRE RISER TENSIONER

This application is a National Stage Application of PCT/US2012/033317, filed 12 Apr. 2012, and which application is incorporated herein by reference. To the extent appropriate, a claim of priority is made to the above disclosed application.

BACKGROUND

Offshore oil drilling and production operations are conducted through a pipe, called a riser, running from a subsea wellhead to a surface platform or floating vessel. In order to support the weight of these risers and to control the stresses induced by ocean currents and vessel motions, the upper end of the riser is connected to a tensioning device. This riser tensioner maintains a predetermined range of tension throughout a range of vertical and lateral motions of the drilling or production rig.

The conventional approach to tensioning risers is to use a combination of a hydraulic or pneumatic mechanical cylinder, pressurized using a compressed gas, to apply the tensioning forces to the riser. Each riser tensioner is located on a deck of the floating platform or floating vessel and is structurally connected through its cylinders to the riser. The cylinders may be connected to the risers with wire rope or chain or directly connected through cylinder rods. The pressurized gas volume is typically contained in a separate pressure vessel referred to as an "accumulator", positioned alongside the cylinder, which supplies sufficient gas volume to act as a gas spring. This combination of cylinder and accumulator acts to compress or expand the gas in response to vessel or riser movements, thereby maintaining a relatively uniform tension level in the riser.

For example, FIG. 1 illustrates a conventional wire riser tensioner system 100 including a double-acting hydraulic cylinder 110, a high-pressure accumulator 130, and a low-pressure accumulator 140. A piston 120 is disposed within an interior of the hydraulic cylinder 110 and configured to slide along an axial direction therein. The piston 120 includes a piston seat 122 and a piston extension 124. The piston seat 122 divides the interior of the cylinder 110 into a first variable-volume section 112 and a second variable-volume section 114. The volumes of the sections 112, 114 vary based on the position of the piston seat 122 within the cylinder 110. The piston extension 124 extends upwardly through the second section 114 of the cylinder 110. In certain implementations, the piston extension 124 may be hollow to reduce the weight of the piston 120.

A first sealing arrangement 127 is disposed at the piston seat 122 of the piston 120 to provide a seal between the first and section sections 112, 114 of the cylinder 110. A second sealing arrangement 129 is disposed between the piston extension 124 and an exterior of the cylinder 110 to seal the interior of the cylinder 110 as the piston 120 is slid therein. The second sealing arrangement 129 is located at an opposite end of the piston 120 from the first sealing arrangement 127.

The high-pressure accumulator 130 defines an interior 132 in which a first high pressure fluid (e.g., oil) may be stored. The high-pressure accumulator 130 is coupled to the cylinder 110 via a first flow path 150. The first flow path 150 provides a fluid pathway between the high-pressure accumulator 130 and the first variable volume section 112 of the cylinder 110. In certain implementations, the first flow path 150 extends between a bottom of the high-pressure accumulator 130 and a bottom of the cylinder 110. In certain implementations, a valve (e.g., an anti-recoil valve, a flow shut-off valve, etc.) 155 is disposed in the first flow path 150.

The high-pressure accumulator 130 also is configured to hold a second high-pressure fluid (e.g., compressed air, compressed nitrogen, or other gas). One or more air pressure vessels (APV's) 170 may be coupled to the high-pressure accumulator 130 via piping 175. Each APV 170 provides additional volume in which to store the second high-pressure fluid. In certain implementations, the APVs 170 are coupled to the high-pressure accumulator 130 using a ball-valve 172 or other valve arrangement. Providing additional volume in which the second high-pressure fluid may be contained aids in stabilizing the pressure of the second high-pressure fluid across the system 100.

The low-pressure accumulator 140 defines an interior 142 in which a low-pressure fluid (e.g., a lubricant) may be stored. The low-pressure accumulator 140 is coupled to the cylinder 110 via a second flow path 160. The second flow path 160 provides a fluid pathway between the low-pressure accumulator 140 and the second variable volume section 114 of the cylinder 110. For example, the second flow path 160 provides a fluid pathway between the low-pressure accumulator 140 and an annulus area around the piston extension 124. In certain implementations, the second flow path 160 extends between a top of the low-pressure accumulator 140 and a top of the cylinder 110. The low-pressure accumulator 140 is isolated from the high-pressure accumulator 130.

Accordingly, as the piston 120 is moved within the cylinder 110, the first high-pressure fluid is moved between the high-pressure accumulator 130 and the first variable-volume section 112 of the cylinder 110 through the first flow path 150. In addition, the low-pressure fluid is moved between the low-pressure accumulator 140 and the second variable volume section 114 of the cylinder 110 through the second flow path 160 as the piston 120 moves in the cylinder 110.

SUMMARY

Aspects of the present disclosure relate to a riser tensioner arrangement including a high-pressure accumulator; a cylinder; a piston slidingly disposed within an interior volume of the cylinder; a first flow path coupling an interior volume of the high-pressure accumulator with a first volume of the cylinder to enable a first high-pressure fluid to flow therebetween; and a second flow path coupling the interior volume of the high-pressure accumulator with a second volume of the cylinder to enable a second high-pressure fluid to flow therebetween. The piston includes a seat and an extension. The piston seat separates the interior volume of the cylinder into the first volume and the second volume. The extension extends upwardly from the seat through the second volume. The extension defines a hollow interior that is coupled to the second volume of the cylinder via at least one aperture.

Other aspects of the present disclosure related to a method of manufacturing a riser tensioner including a high-pressure accumulator and a pusher-type cylinder. The method includes hollowing an interior of a piston-rod to provide an interior volume; defining at least one aperture through a sidewall of the piston-rod to provide access to the interior volume of the piston-rod; and positioning the piston-rod within a cylinder to separate an interior volume of the cylinder into first and second variable-volume sections. The second variable-volume section includes the hollow interior of the piston-rod and a volume of an annulus area around the piston-rod. In certain implementations, the method also may include coupling a first end of the high-pressure accumulator to the first variable-volume section of the cylinder via a first flow path; and coupling a second end of the high-pressure accumulator to the second variable-volume section of the cylinder via a second flow path.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 2:
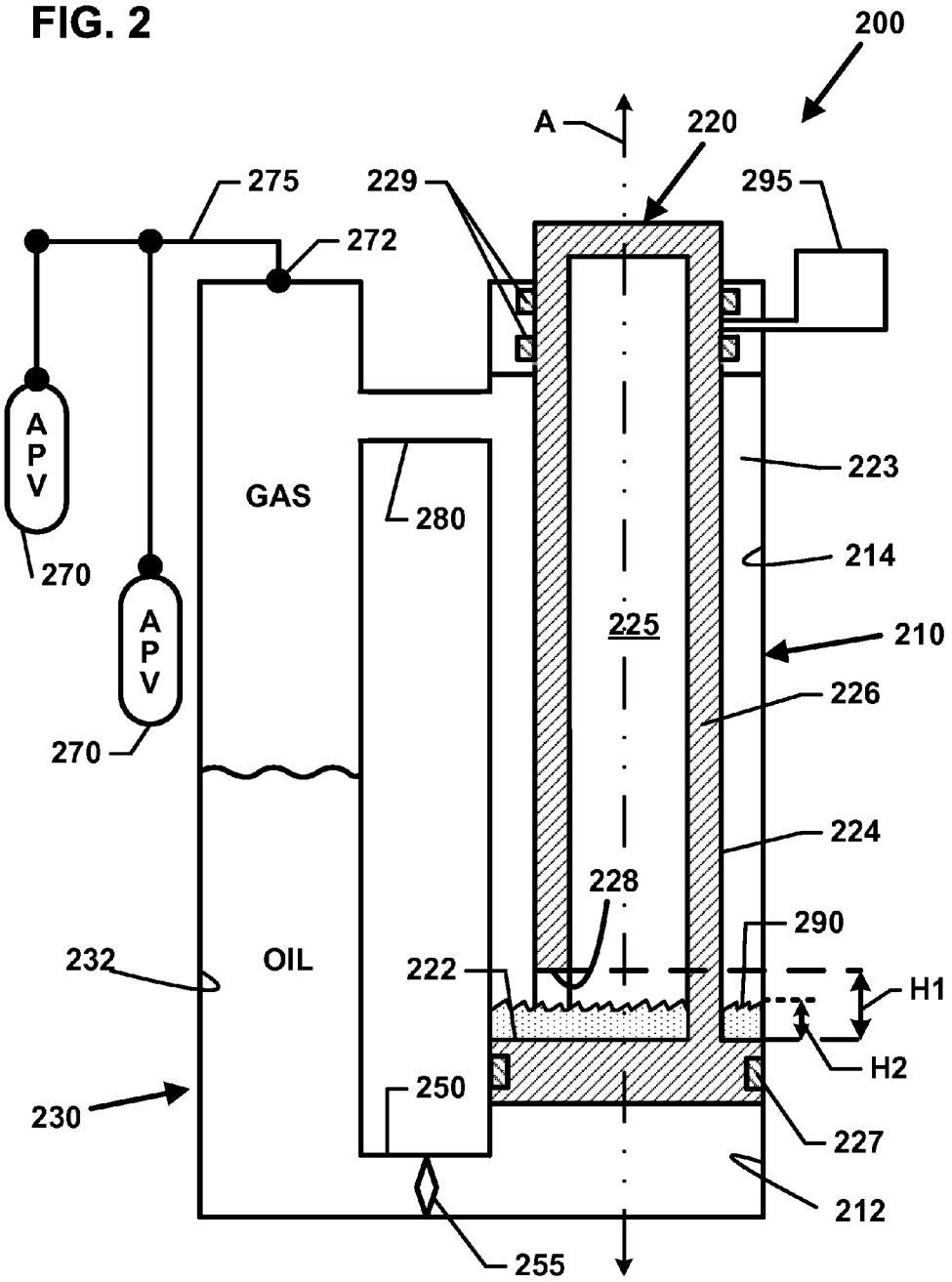
FIG. 2 is a schematic diagram of an example riser tensioner system including a hydraulic cylinder having a piston defining a hollow space accessible through apertures defined in a sidewall of the piston.

FIG. 2 illustrates an example riser tensioner system 200 including a hydraulic cylinder 210 and a high-pressure accumulator 230. The riser tensioner system 200 does not include a low-pressure accumulator. A piston 220 is disposed within an interior of the hydraulic cylinder 210 and is configured to slide along an axial direction A therein. The piston 220 includes a piston seat 222 and a piston extension 224. The piston seat 222 divides the interior of the cylinder 210 into a first variable-volume section 212 and a second variable-volume section 214. The volumes of the sections 212, 214 vary based on the position of the piston seat 222 within the cylinder 210.

The piston extension 224 includes a sidewall 226 that extends upwardly from the piston seat 222 through the cylinder 210 to define an annular region 223 around the sidewall 226. As the piston 220 slides within the cylinder 210, the annular region 223 around the piston extension 224 grows and shrinks (e.g., compare FIGS. 2 and 3). The piston sidewall 226 defines a hollow interior 225 that is accessible from the annular region 223 through one or more apertures 228 defined in the sidewall 226. Accordingly, the second variable-volume section 214 of the cylinder 210 is defined by the annular region 223 around the piston extension 224 and the hollow interior 225 of the piston extension 224.

The one or more apertures 228 are disposed in the sidewall 226 above the piston seat 222. In certain implementations, multiple apertures 228 are circumferentially spaced in a ring around the piston extension 224. In certain implementations, the apertures 228 are disposed in a ring disposed directly above the piston seat 222. In certain implementations, the apertures 228 include a single row of circumferentially spaced apertures 228. In other implementations, additional rings of apertures 228 may be provided.

A first sealing arrangement 227 is disposed at the piston seat 222 of the piston 220 to provide a seal between the first and second variable-volume sections 212, 214 of the cylinder 210. The first sealing arrangement 227 is configured to slide with the piston seat 222 along an inner wall of the cylinder 210. A second sealing arrangement 229 is disposed between the sidewall 226 of the piston extension 224 and an exterior of the cylinder 210 to seal the interior of the cylinder 210 as the piston 220 is slid therethrough. The second sealing arrangement 229 is located at an opposite end of the piston 220 from the first sealing arrangement 227. Each sealing arrangement 227, 229 may include one or more O-rings or other sealing structures.

To aid in lubricating the first sealing arrangement 227 of the piston 220 when the piston 220 slides within the cylinder 210, a lubricant bath 290 may be supplied in the second variable-volume section 214 of the cylinder 210. The lubricant bath 290 includes a volume of lubricant disposed on the piston seat 222 to provide lubrication to the first sealing arrangement 227 as the piston 220 slides within the cylinder 210. In certain implementations, the lubricant bath 290 only partially fills the cylinder 210. In certain implementations, the lubricant bath 290 has a volume that is substantially smaller than the second variable-volume section 214 of the cylinder 210. In the example shown, the lubricant bath 290 has a height H2 that is less than a height H1 of the apertures 228 extending through the sidewall 226 of the piston 220 (see FIG. 2).

Figure 1:
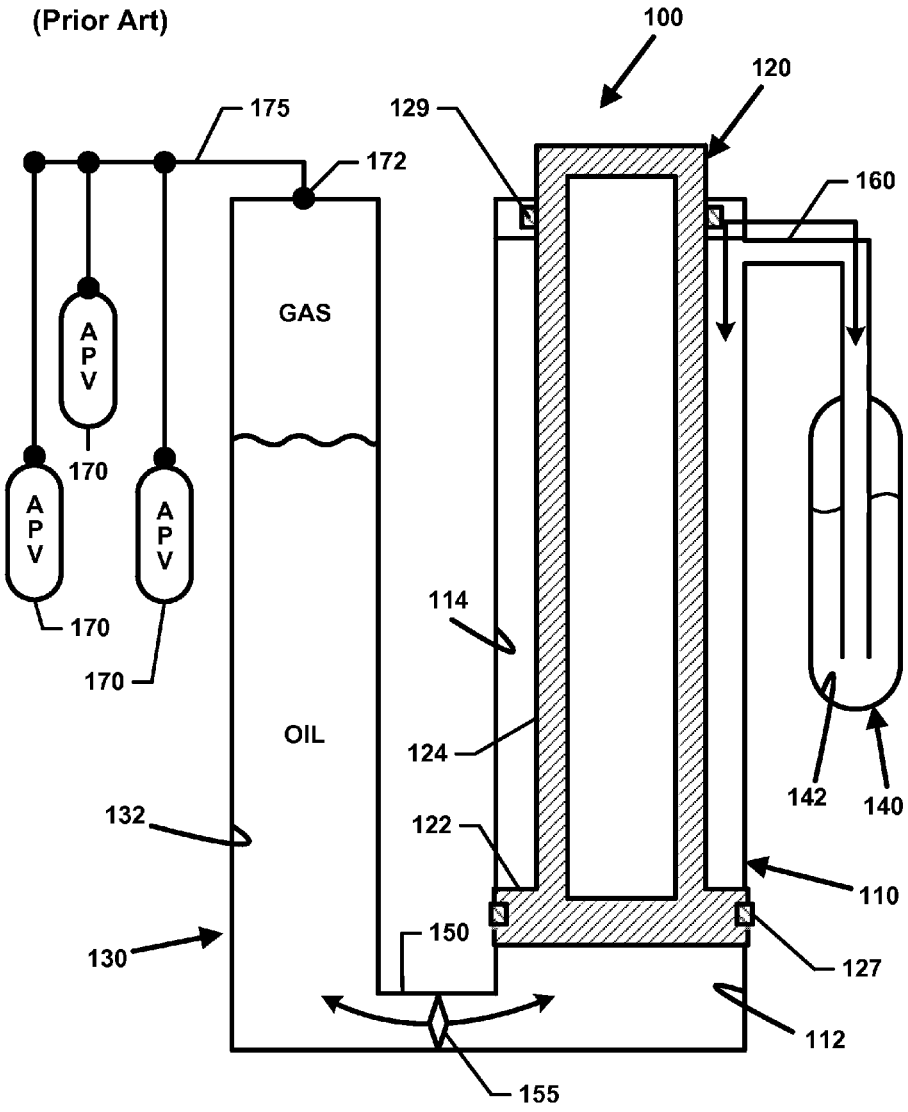
FIG. 1 (Prior Art)
FIG. 1 is a schematic diagram of a conventional riser tensioner system.

In some implementations, a lubrication tank 295 is coupled to the cylinder 210 to provide lubricant to the second sealing arrangement 229 of the piston 220. In certain implementations, the lubrication tank 295 is isolated from the second variable-volume section 214 of the cylinder 210. The lubrication tank 295 is substantially smaller than the low pressure accumulator 140 of FIG. 1. In certain implementations, the lubrication tank 295 is substantially smaller than the second variable-volume section 214 of the cylinder 210. In the example shown, the lubrication tank 295 is substantially smaller than annular region 223 extending between the sidewalls 226 of the piston 220 and the inner surface of the cylinder 210.

A first high pressure fluid (e.g., a non-compressible fluid such as oil or other liquid) may flow between the first variable-volume section 212 of the cylinder 210 and an interior 232 of the high-pressure accumulator 230. In certain implementations, the high-pressure accumulator 230 is coupled to the cylinder 210 via a first flow path 250. The first flow path 250 provides a fluid pathway between the interior 232 of the high-pressure accumulator 230 and the first variable-volume section 212 of the cylinder 210. In certain implementations, the first flow path 250 extends between a bottom of the high-pressure accumulator 230 and a bottom of the cylinder 210. In certain implementations, a valve (e.g., an anti-recoil valve) 255 is disposed in the first flow path 250 to control fluid flow between the cylinder 210 and the accumulator 230.

The high-pressure accumulator 230 also is configured to hold a second high-pressure fluid (e.g., a compressible fluid such as compressed air, compressed nitrogen, or other gas). The second high-pressure fluid acts as a spring (e.g., via compression and decompression) against the first high-pressure fluid. A second flow path 280 extends between the high-pressure accumulator 230 and the cylinder 210 for passage of the second high-pressure fluid therebetween. In particular, the second flow path 280 provides a fluid pathway between the high-pressure accumulator 230 and the second variable volume section 214 of the cylinder 210. In certain implementations, the second flow path 280 extends between a location towards a top of the high-pressure accumulator 230 and a location towards a top of the cylinder 210.

One or more air pressure vessels (APV's) 270 may be coupled to the high-pressure accumulator 230 via piping 275. Each APV 270 provides additional volume in which to store the second high-pressure fluid. In certain implementations, the APVs 270 are coupled to the high-pressure accumulator 230 using a ball-valve 272 or other valve arrangement. The extra volume gained from the piston extension interior 225 and annulus space around the piston extension 224 of the cylinder 210 increases the total gas capacity of the system without enlarging the volume of the high-pressure accumulator 230 or adding additional APV's 270. In certain implementations, the number of APV's 270 utilized in a system may be reduced, thereby reducing cost and the spatial footprint of the system. In the example shown in FIG. 2, the riser tensioner system 200 includes fewer APV's 270 than the conventional riser tensioner system 100 of FIG. 1.

Figure 3:
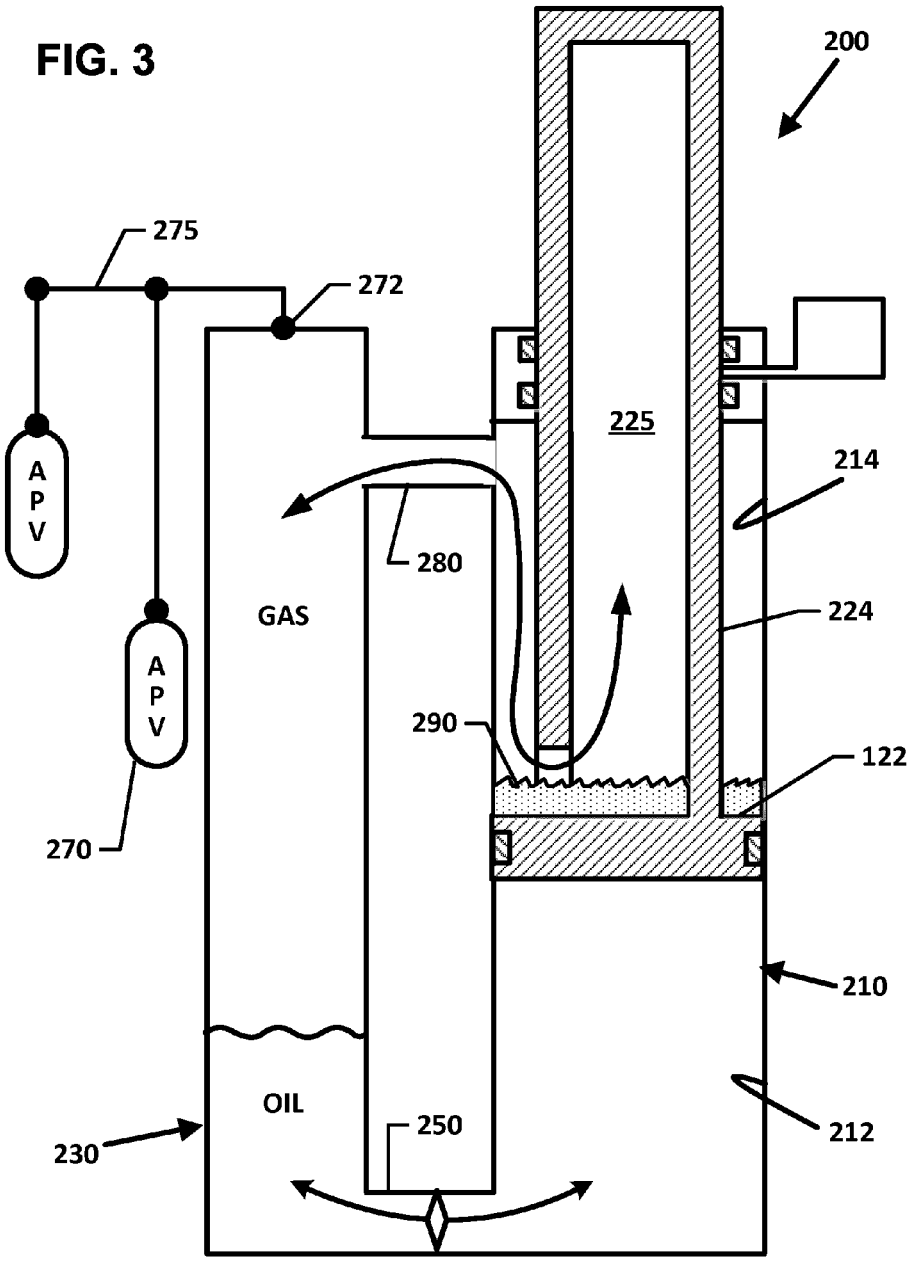
FIG. 3 is a schematic diagram of the example riser tensioner system of FIG. 2 showing the piston moved to a second position.

FIG. 3 illustrates example fluid flow of the first high-pressure fluid along the first flow path 250 between the accumulator 230 and the cylinder 210. FIG. 3 also illustrates example fluid flow of the second high-pressure fluid along the second flow path 280 between the accumulator 230 and the cylinder 210. As the piston 220 slides upwardly along the axis A, the first high-pressure fluid stored in the accumulator 230 flows into the first variable-volume section 212 of the cylinder 210 through the first flow path 250. The annular region 223 in the second variable-volume section 214 of the cylinder 210 shrinks. Accordingly, the second high-pressure fluid compresses. The pressure of the second fluid stabilizes across the system including the hollow interior 225 of the piston extension 224, the annular region 223 of the cylinder 210, the interior 232 of the accumulator 230, and any connected APVs.

As the piston 220 slides downwardly along the axis A, the piston seat 222 pushes the first high-pressure fluid back into the accumulator 230 through the first flow path 250. The piston seat 222 may draw the second fluid into the second variable-volume section 214 from the accumulator 230 through the second flow path 280. The pressure of the second fluid stabilizes across the system including the hollow interior 225 of the piston extension 224, the annular region 223 of the cylinder 210, the interior 232 of the accumulator 230, and any connected APVs.

Figure 4:
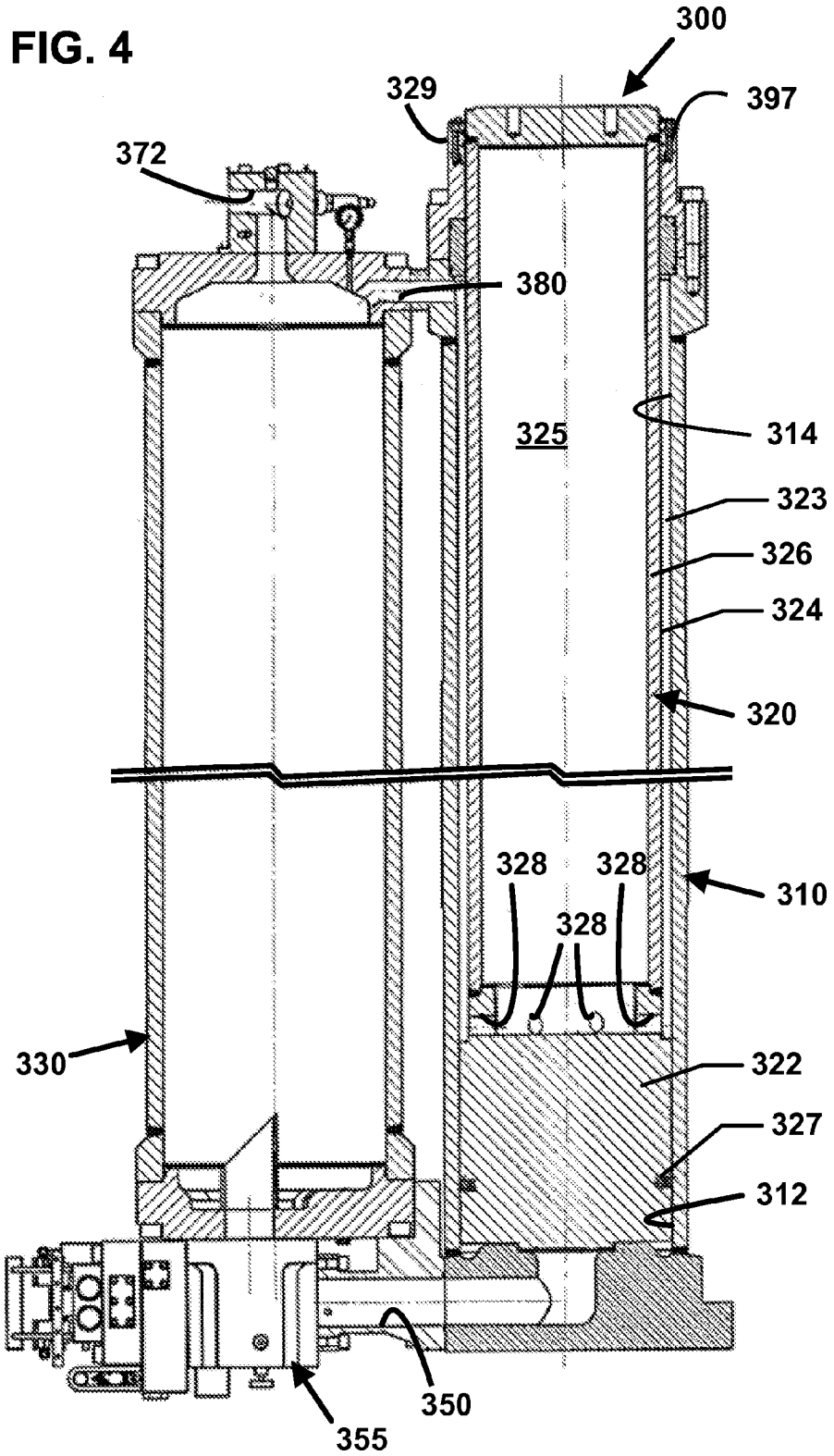
FIG. 4 is a diagram of another example riser tensioner system having features that are examples of inventive aspects of the present disclosure.

FIG. 4 illustrates another example implementation of a riser tensioner system 300 including a hydraulic cylinder 310 and a high-pressure accumulator 330. The riser tensioner system 300 does not include a low-pressure accumulator. A piston 320 is disposed within an interior of the hydraulic cylinder 310 and is configured to slide along an axial direction therethrough. The piston 320 includes a piston seat 322 and a piston extension 324. The piston seat 322 divides the interior of the cylinder 310 into a first variable-volume section 312 and a second variable-volume section 314. The volumes of the sections 312, 314 vary based on the position of the piston seat 322 within the cylinder 310.

The piston extension 324 includes a sidewall 326 that extends upwardly from the piston seat 322 through the cylinder 310 to define an annular region 323 around the sidewall 326. As the piston 320 slides within the cylinder 310, the annular region 323 around the piston extension 324 grows and shrinks. In the example shown, the annular region 323 has substantially less volume than the hollow interior 325 of the piston extension 324. In other implementations, however, piston extension 324 may be sized so that the annular region 323 has a greater or lesser volume. The piston sidewall 326 defines a hollow interior 325 that is accessible from the annular region 323 through one or more apertures 328 defined in the sidewall 326. Accordingly, the second variable-volume section 314 of the cylinder 310 is defined by the annular region 323 around the piston extension 324 and the hollow interior 325 of the piston extension 324. In the example shown, four apertures 328 are visible extending through the piston sidewall 326 in a ring. In other implementations, a greater or lesser number of apertures 328 may be provided in the piston 320.

A first sealing arrangement 327 is disposed at the piston seat 322 of the piston 320 to provide a seal between the first and second variable-volume sections 312, 314 of the cylinder 310. The example piston seat 322 shown in FIG. 4 is taller than the piston seat 222 shown in FIGS. 2 and 3. A second sealing arrangement 329 is disposed between the piston extension 324 and an exterior of the cylinder 310 to seal the interior of the cylinder 310 as the piston 320 is slid therethrough. The second sealing arrangement 329 is located at an opposite end of the piston 320 from the first sealing arrangement 327. A conduit 397 for connection to a lubrication tank port is provided at the second sealing arrangement 329.

A valve conduit 372 also is provided at the top of the high-pressure accumulator 330 for receiving piping to connect one or more APVs. First and second fluid conduits 350, 380 also are shown extending between the cylinder 310 and the high-pressure accumulator 330. In the example shown, the first flow path 350 has a larger cross-dimension (e.g., diameter) than the second flow path 380. In other implementations, each of the flow paths 350, 380 may have a greater or lesser cross-dimension. In certain implementations, the first flow path 350 passes through a valve 355 and the second flow path 380 is open.

Having described the preferred aspects and implementations of the present disclosure, modifications and equivalents of the disclosed concepts may readily occur to one skilled in the art. However, it is intended that such modifications and equivalents be included within the scope of the claims which are appended hereto.

The invention claimed is:

1. A riser tensioner arrangement comprising:

a high-pressure accumulator defining an interior volume configured to hold a first high-pressure fluid and a second high-pressure fluid;

a cylinder defining an interior volume;

a piston slidingly disposed within the interior volume of the cylinder, the piston including a sealing section and an extension section, the sealing section separating the interior volume of the cylinder into a first volume and a second volume, the extension section extending upwardly from the sealing section through the second volume, the extension section defining a hollow interior that is coupled to the second volume of the cylinder via at least one aperture;

a first flow path coupling the interior volume of the high-pressure accumulator with the first volume of the cylinder to enable the first high-pressure fluid to flow therebetween; and a second flow path coupling the interior volume of the high-pressure accumulator with the second volume of the cylinder to enable the second high-pressure fluid to flow therebetween.

2. The riser tensioner arrangement of claim 1, wherein the first high-pressure fluid includes an oil and the second high-pressure fluid includes a gas.

3. The riser tensioner arrangement of claim 1, wherein the hollow interior defined by the extension section is coupled to the second volume of the cylinder via a plurality of circumferentially spaced apertures.

4. The riser tensioner arrangement of claim 3, wherein the apertures are disposed adjacent the sealing section.

5. The riser tensioner arrangement of claim 1, further comprising an anti-recoil valve disposed in the first flow path.

6. The riser tensioner arrangement of claim 1, further comprising a lubricant bath located in the second volume of the cylinder at the sealing section of the piston.

7. The riser tensioner arrangement of claim 1, further comprising:

a sealing arrangement that seals the extension section of the piston against an exterior of the cylinder; and a lubricant tank coupled to the cylinder at the sealing arrangement to provide lubricant to the sealing arrangement.

8. The riser tensioner arrangement of claim 1, further comprising at least one air pressure vessel coupled to the interior volume of the high-pressure accumulator via a valve arrangement.

9. The riser tensioner arrangement of claim 1, wherein the second flow path is an open flow path.

10. A method of manufacturing a riser tensioner including a high-pressure accumulator and a pusher-type cylinder, the method comprising:

hollowing an interior of a piston-rod to provide an interior volume;

defining at least one aperture through a sidewall of the piston-rod to provide access to the interior volume of the piston-rod;

positioning the piston-rod within a cylinder to separate an interior volume of the cylinder into first and second variable-volume sections, the second variable-volume section including the hollow interior of the piston-rod and a volume of an annulus area around the piston-rod;

coupling a first end of the high-pressure accumulator to the first variable-volume section of the cylinder via a first flow path; and coupling a second end of the high-pressure accumulator to the second variable-volume section of the cylinder via a second flow path.

11. The method of claim 10, wherein coupling the first end of the high-pressure accumulator to the first variable-volume section of the cylinder via the first flow path comprises disposing an anti-recoil valve arrangement within the first flow path.

12. The method of claim 10, wherein defining the at least one aperture through the sidewall of the piston-rod comprises defining a plurality of circumferentially spaced apertures through the sidewall of the piston-rod.

13. The method of claim 10, further comprising:

positioning a sealing arrangement at one end of the cylinder to seal the piston-rod from an exterior of the cylinder; and coupling a lubricant tank to the cylinder to provide lubricant to the sealing arrangement.

14. The method of claim 10, further comprising:

filling a first part of an interior volume of the high-pressure accumulator with a high-pressure oil; and filling a second part of the interior volume of the high-pressure accumulator with a high-pressure gas.

15. The method of claim 14, wherein filling the second part of the interior volume of the high-pressure accumulator with the high-pressure gas comprises filling the second variable-volume section of the cylinder with the high-pressure gas.

16. The method of claim 15, wherein the second variable-volume of the cylinder is at least 40% of the second part of the interior volume of the high-pressure accumulator.

17. The method of claim 15, wherein the second variable-volume of the cylinder is at least 50% of the second part of the interior volume of the high-pressure accumulator.

18. The method of claim 15, wherein the second variable-volume of the cylinder is at least 60% of the second part of the interior volume of the high-pressure accumulator.

* * * * *